US009004670B2

(12) United States Patent
Kikugawa

(10) Patent No.: US 9,004,670 B2
(45) Date of Patent: Apr. 14, 2015

(54) TEMPERATURE ADJUSTING MEMBER AND PRINTER INCLUDING THE SAME

(71) Applicant: Panasonic Corporation, Osaka (JP)

(72) Inventor: Masaaki Kikugawa, Kumamoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/445,553

(22) Filed: Jul. 29, 2014

(65) Prior Publication Data

US 2015/0054894 A1 Feb. 26, 2015

(30) Foreign Application Priority Data

Aug. 21, 2013 (JP) ..... 2013-171035
Feb. 21, 2014 (JP) ..... 2014-031347

(51) Int. Cl.

| | |
|---|---|
| ***B41J 2/01*** | (2006.01) |
| ***G03G 15/20*** | (2006.01) |
| ***B41J 29/377*** | (2006.01) |
| ***F25B 21/02*** | (2006.01) |
| ***B41J 11/00*** | (2006.01) |

(52) U.S. Cl.

CPC ..... *B41J 29/377* (2013.01); *F25B 21/02* (2013.01); *B41J 11/002* (2013.01); *F25B 2321/023* (2013.01)

(58) Field of Classification Search

USPC ..... 347/18, 102; 165/104.5, 104.33, 122, 165/185; 219/619; 252/70; 55/282.2; 257/E23.088, E23.11; 399/330, 336

See application file for complete search history.

(56) References Cited

U.S. PATENT DOCUMENTS 7,220,365 B2 * 5/2007 Qu et al. ..... 252/70

FOREIGN PATENT DOCUMENTS

JP 360041526 * 3/1985 ..... 55/282.3
JP 05-301336 A 11/1993

* cited by examiner

*Primary Examiner* — Anh T. N. Vo
(74) *Attorney, Agent, or Firm* — McDermott Will & Emery LLP

(57) ABSTRACT

A temperature adjusting member includes: a thermoelectric conversion module; a casing which contains the thermoelectric conversion module; an exterior pipe which contains the casing; and a support body which brings the casing into contact with an inner wall of the exterior pipe. The support body includes a holding portion, a connecting portion and a support portion. The holding portion holds the casing; the connecting portion is connected to the holding portion; and the support portion supports the holding portion by the connecting portion. The connecting portion is connected to the support portion such that the holding portion is movable toward the inner wall of the exterior pipe.

12 Claims, 17 Drawing Sheets

TEMPERATURE ADJUSTING MEMBER AND PRINTER INCLUDING THE SAME

CROSS REFERENCE TO RELATED APPLICATIONS

The present application claims priority to Japanese Patent Application No. 2013-171035 (filed on Aug. 21, 2013) and Japanese Patent Application No. 2014-031347 (filed on Feb. 21, 2014), both which are incorporated herein in their entirety by reference thereto.

BACKGROUND

The disclosure relates to a temperature adjusting member which is mounted on electronic equipment such as a printer for industrial use and uses a roller and a cylinder, and more particularly to a temperature adjusting member which can perform cooling or heating by a Peltier effect.

In performing both-side printing by using a printer for industrial use, an ink drying part (hereinafter referred to as "dryer") dries a printed matter after surface printing. Then, printing is performed to a back surface of the dried printed matter after surface printing. The dryer dries ink by increasing a temperature of the printed matter after surface printing, and hence the printed matter immediately after drying by the dryer becomes a high temperature. Accordingly, when back surface printing is performed in such a state, printing quality becomes unstable.

To solve this problem, a plurality of rollers are disposed in a printer for industrial use between a surface printing part which performs surface printing and a back surface printing part which performs back surface printing. Then, by conveying the printed matter using these rollers and, at the same time, by making these rollers absorb heat from the printed matter while being in contact with the printed matter, the printed matter after surface printing is cooled to a temperature at which back surface printing can be performed properly.

SUMMARY

A temperature adjusting member according to various exemplary embodiments of this disclosure includes: a thermoelectric conversion module; a casing which contains the thermoelectric conversion module; an exterior pipe which contains the casing; and a support body which brings the casing into contact with an inner wall of the exterior pipe. The support body includes a holding portion, a connecting portion and a support portion: the holding portion holds the casing; the connecting portion is connected to the holding portion; and the support portion supports the holding portion through the connecting portion, and the connecting portion is connected to the support portion such that the holding portion is movable toward the inner wall of the exterior pipe.

Further, a printer according to various exemplary embodiments of this disclosure includes: a temperature adjusting member; a front surface printing part which applies printing on a front surface of a material to be printed; a dryer which dries a printed matter formed by printing by the front surface printing part; and a back surface printing part which applies printing on a back surface of the printed matter. The printed matter dried by the dryer is printed by the back surface printing part after a temperature of the printed matter is adjusted by the temperature adjusting member. The temperature adjusting member includes: a thermoelectric conversion module; a casing which contains the thermoelectric conversion module; an exterior pipe which contains the casing; and a support body which brings the casing into contact with an inner wall of the exterior pipe. The support body includes a holding portion, a connecting portion and a support portion: the holding portion holds the casing; the connecting portion is connected to the holding portion; and the support portion supports the holding portion through the connecting portion, and the connecting portion is connected to the support portion such that the holding portion is movable toward the inner wall of the exterior pipe.

DESCRIPTION OF PREFERRED EMBODIMENTS

Problems which exemplary embodiments of this disclosure intend to solve are as follows.

As described in the background previously, a printed matter after surface printing is dried by a dryer so that the printed matter becomes a high temperature. Accordingly, in a conventional printer for industrial use, a printed matter is conveyed using a plurality of rollers so as to cool the printed matter making a high temperature to an appropriate temperature.

However, in the above-mentioned constitution, heat of the printed matter immediately after drying by the dryer is absorbed by the plurality of rollers. Accordingly, time necessary for cooling the printed matter to an appropriate temperature depends on the number of rollers, times during which the printed matter is in contact with the rollers, and heat absorbing efficiencies of roller bodies. As a result, to miniaturize the printer or to shorten a printing time, it is necessary to increase heat absorbing efficiency of each roller body.

The temperature adjusting member according to the exemplary embodiments of this disclosure is configured such that a printed matter can be adjusted to an appropriate temperature within a short time and hence, the printer can be miniaturized or a printing time can be shortened.

Hereinafter, the temperature adjusting member according to exemplary embodiments of this disclosure is described by referring to drawings. A roller or a cylinder may preferably be used as the temperature adjusting member according to the exemplary embodiments of this disclosure. The roller conveys a printed matter due to its rotation in a printer, and the cylinder conveys a printed matter in a state where the cylinder is fixed to the printer. Hereinafter, the constitution of a temperature adjusting member which is formed using a roller is described. The explanation of the constitution of the cylinder is omitted because the cylinder substantially has the same appearance and the same internal structure as the roller.

In the explanation of various exemplary embodiments made hereinafter, unless otherwise specified, the identical constitutions are given the same symbols and the repeated explanation of the constitutions is omitted.

First Exemplary Embodiment

Figure 1:
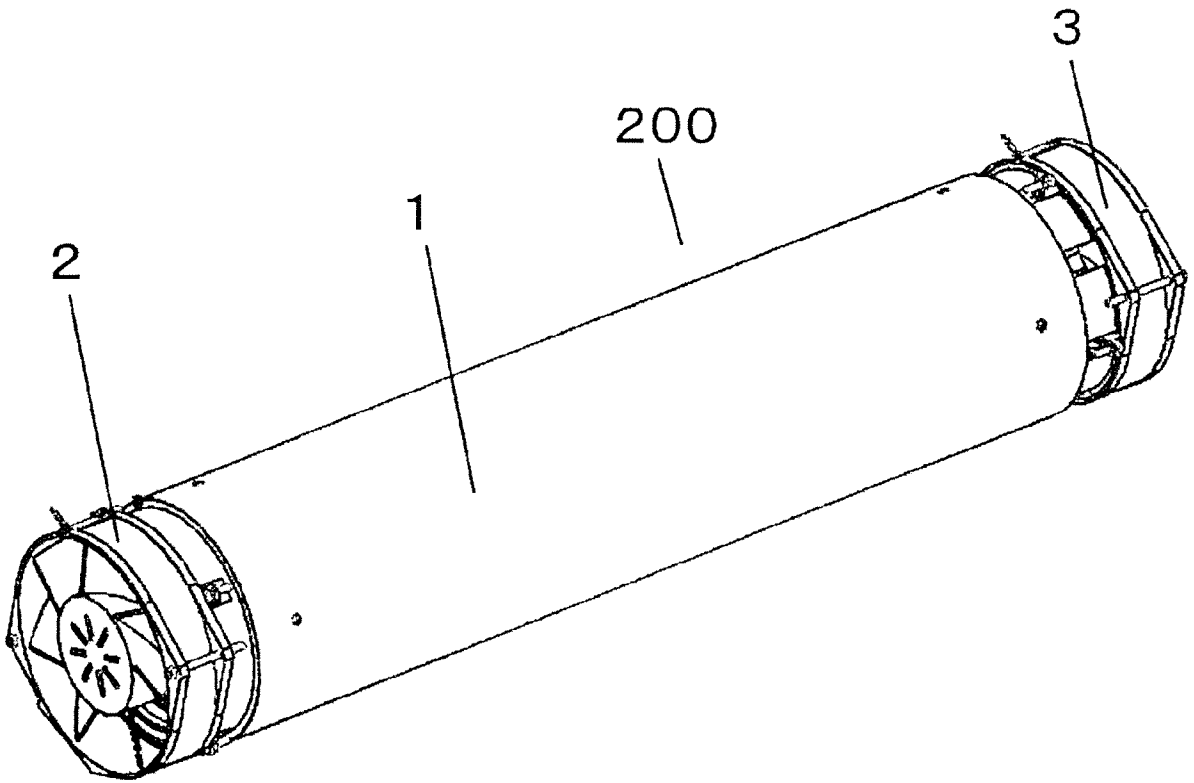
FIG. 1 is an appearance view of a cooling roller according to a first exemplary embodiment.

FIG. 1 is an appearance view of cooling roller 200 according to a first exemplary embodiment. Cooling roller 200 includes: roller body 1; outside air suction fan 2; and inside air discharge fan 3. Roller body 1 has a function of cooling the exterior of roller body 1. Outside air suction fan 2 supplies air which is present outside of roller body 1 into the inside of roller body 1, and inside air discharge fan 3 discharges air inside roller body 1 to the outside.

Figure 2:
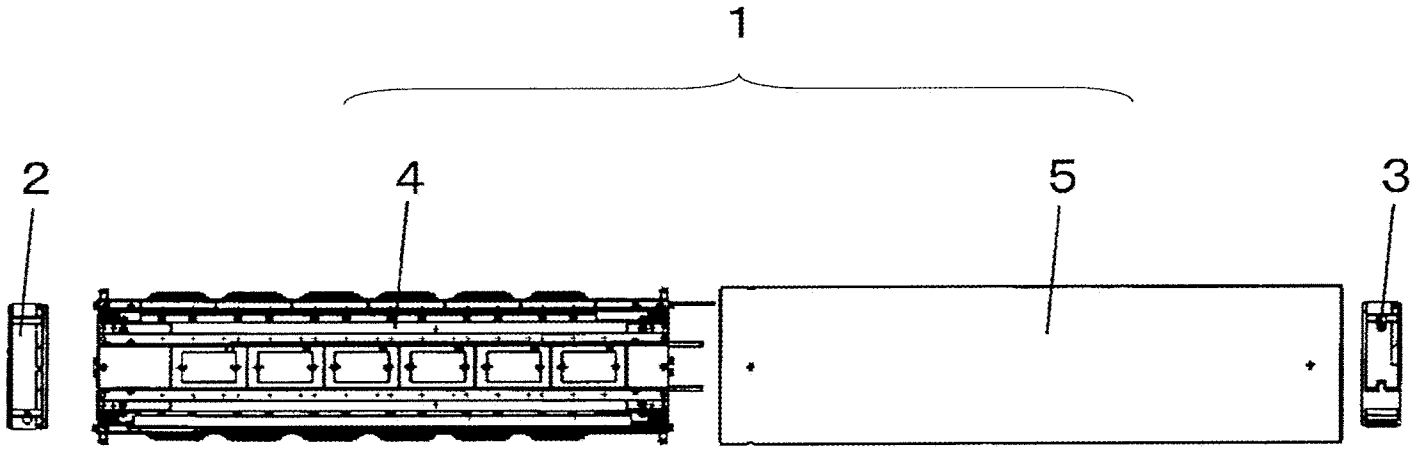
FIG. 2 is an exploded view of a roller body according to the first exemplary embodiment.

FIG. 2 is an exploded view of roller body 1 according to the first exemplary embodiment. Roller body 1 is constituted of roller cooling body 4 and roller exterior pipe 5. Roller cooling body 4 has a function of cooling roller exterior pipe 5, and is disposed inside roller exterior pipe 5. Roller cooling body 4 has an approximately cylindrical shape which conforms to an inner wall of roller exterior pipe 5.

Figure 3:
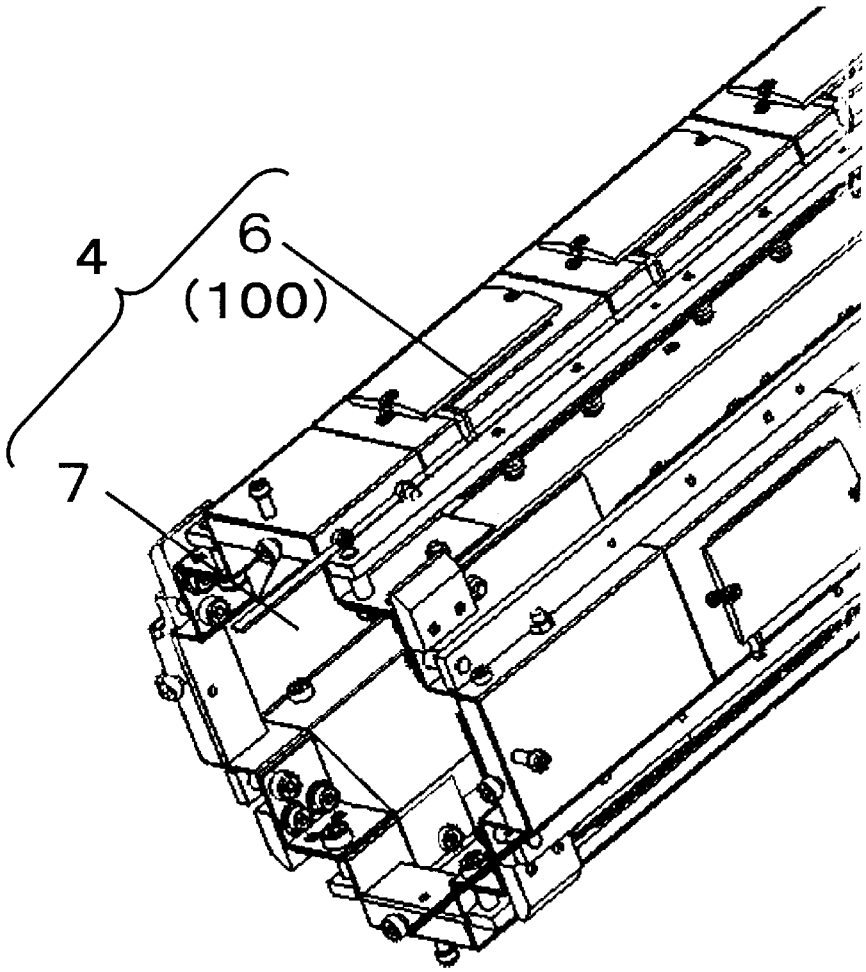
FIG. 3 is an enlarged view of a roller cooling body according to the first exemplary embodiment.

FIG. 3 is an enlarged view of roller cooling body 4 according to the first exemplary embodiment. Roller cooling body 4 includes cooling units 100 and support portion 7. The plurality of cooling units 100 are supported by support portion 7.

Figure 4:
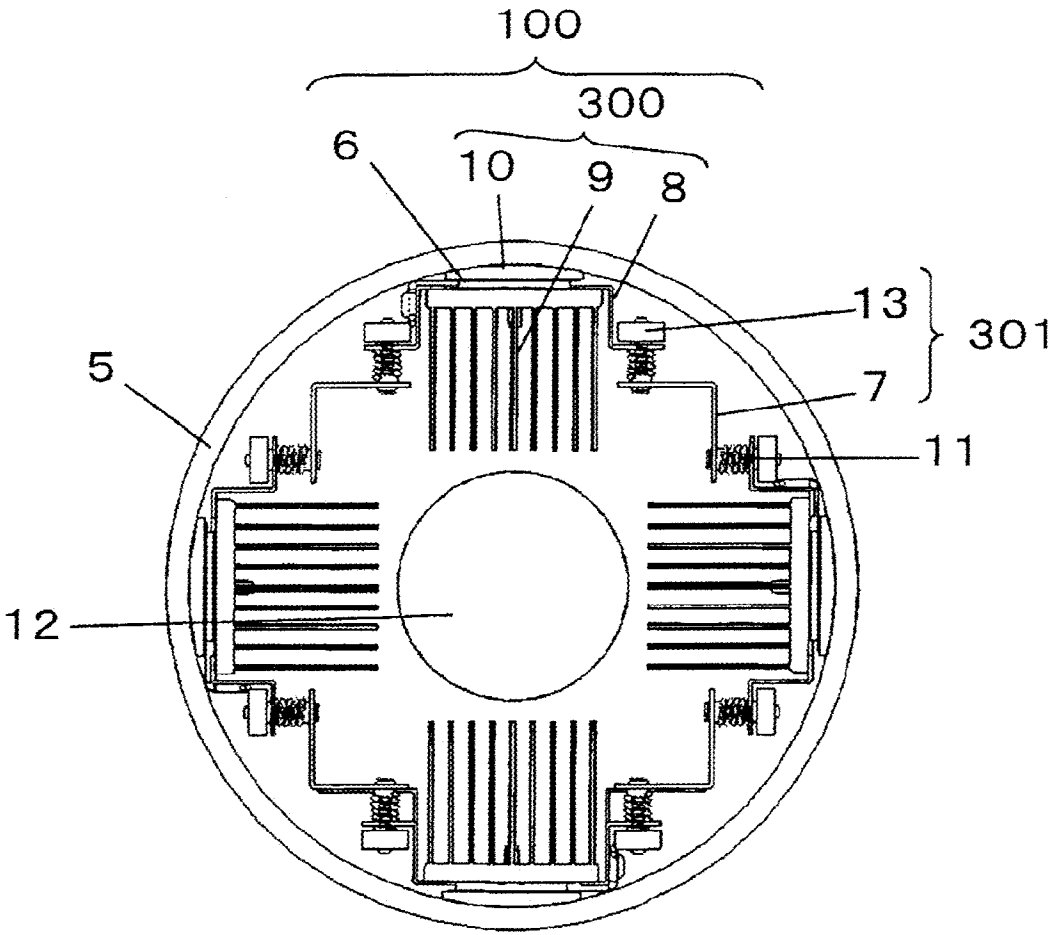
FIG. 4 is a view showing the internal structure of the roller body according to the first exemplary embodiment.
Figure 5:
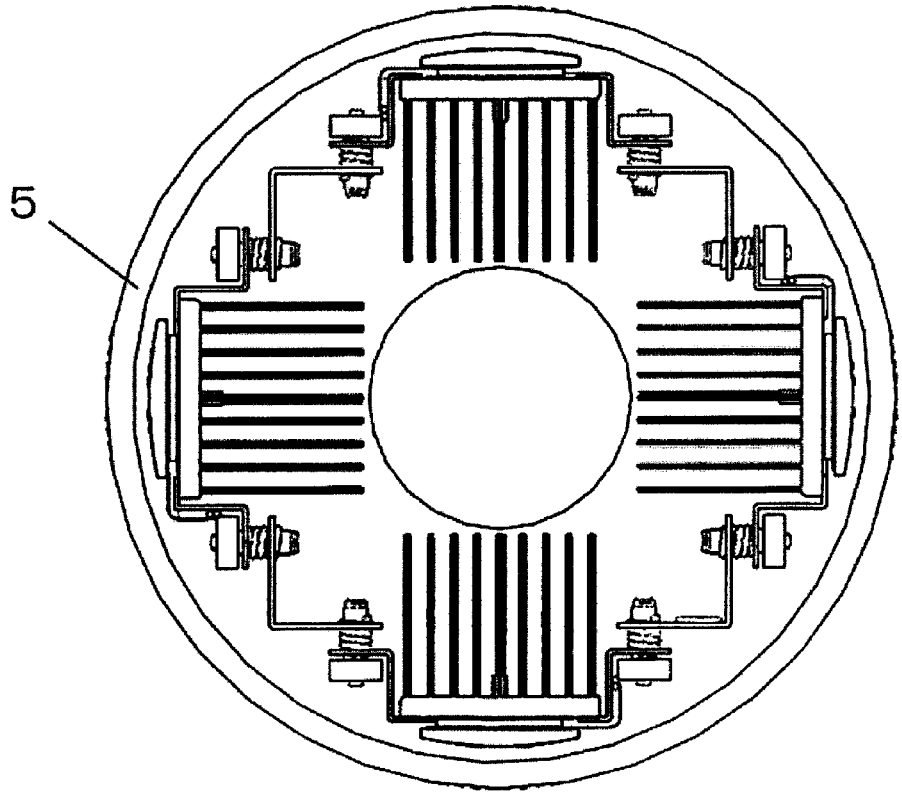
FIG. 5 is a view showing the internal structure of the roller body according to the first exemplary embodiment.

FIG. 4 and FIG. 5 show the internal structure of roller body 1 according to the first exemplary embodiment. FIG. 4 shows a state where roller exterior pipe 5 and roller cooling body 4 are brought into close contact with each other, and FIG. 5 shows a state where roller exterior pipe 5 and roller cooling body 4 are separated from each other.

Cooling unit 100 includes curved plate 10, thermoelectric conversion module 6, heat radiation member 9, and mounting plate 8. Curved plate 10, thermoelectric conversion module 6 and heat radiation member 9 are disposed in this order from the position close to the inner wall of roller exterior pipe 5. Mounting plate 8 is disposed so as to surround side surfaces of thermoelectric conversion module 6. Although there may a case where air flow direction adjusting pole 12 is disposed inside cooling roller 200, the case is described later.

Curved plate 10 has a surface which conforms to the inner wall of roller exterior pipe 5 such that curved plate 10 can be readily brought into close contact with the inner wall of roller exterior pipe 5. Since the curved plate 10 has such a surface, when curved plate 10 is in contact with the inner wall of roller exterior pipe 5, curved plate 10 can efficiently transfer heat of roller exterior pipe 5 to thermoelectric conversion module 6. Thermoelectric conversion module 6 is configured to lower a temperature of a surface of thermoelectric conversion module 6 on a curved plate 10 side and to increase a temperature of a surface of thermoelectric conversion module 6 on a heat radiation member 9 side. A plurality of thermoelectric conversion elements are disposed on each one thermoelectric conversion module 6. Heat radiation member 9 has the fin structure, and radiates heat generated by thermoelectric conversion module 6. The whole cooling unit 100 including thermoelectric conversion module 6 is fixed to support portion 7 by mounting plate 8. Due to such a constitution, the position of thermoelectric conversion module 6 with respect to support body 301 is determined by mounting plate 8.

Curved plate 10 and heat radiation member 9 are disposed so as to sandwich thermoelectric conversion module 6 therebetween in the vertical direction, and mounting plate 8 is disposed so as to surround the side surfaces of thermoelectric conversion module 6. That is, casing 300 which contains thermoelectric conversion module 6 therein is constituted of curved plate 10, heat radiation member 9 and mounting plate 8. Cooling unit 100 is formed by containing thermoelectric conversion module 6 in casing 300, and cooling unit 100 is fixed to support portions 7 by mounting plate 8.

The plurality of cooling units 100 are disposed on roller cooling body 4. Each cooling unit 100 is mounted on each unit movable plate 13. By fixing unit movable plate 13 and support portion 7 to each other using spring-mounted bolt 11, the position of cooling unit 100 with respect to support portion 7 is determined. Spring mounted bolt 11 is constituted of a male screw and a spring disposed around threads of the male screw.

Spring mounted bolt 11 is mounted in a state where spring mounted bolt 11 penetrates unit movable plate 13 and support portion 7. A spring of spring mounted bolt 11 is disposed between unit movable plate 13 and support portion 7. Due to such a constitution, when spring mounted bolt 11 is rotated in the direction that spring mounted bolt 11 is loosened with respect to support portion 7, the spring disposed around threads makes unit movable plate 13 move in the direction that the movable plate 13 approaches the inner wall of roller exterior pipe 5. Cooling unit 100 is mounted on unit movable plate 13 and hence, cooling unit 100 is moved in the direction that the cooling unit 100 approaches the inner wall of roller exterior pipe 5 in accordance with the movement of unit movable plates 13. Thereafter, when spring mounted bolt 11 is continuously rotated in the direction that spring mounted bolt 11 is loosened with respect to support portion 7, as shown in FIG. 4, curved plate 10 which constitutes a part of cooling unit 100 can be brought into close contact with the inner wall of roller exterior pipe 5.

On the other hand, when spring mounted bolt 11 is rotated in the direction that spring mounted bolt 11 is fastened with respect to support portion 7, unit movable plate 13 is moved in the direction away from the inner wall of roller exterior pipe 5 while compressing the spring. Cooling unit 100 is mounted on unit movable plates 13 and hence, cooling unit 100 is moved in the direction away from the inner wall of roller exterior pipe 5 in accordance with the movement of unit movable plates 13. Thereafter, when spring mounted bolt 11 is continuously rotated in the direction that spring mounted bolt 11 is fastened with respect to support portion 7, as shown in FIG. 5, curved plate 10 which constitutes cooling unit 100 can be separated from the inner wall of roller exterior pipe 5.

In this manner, the pressing mechanism of cooling unit 100 is constituted of support portion 7, unit movable plate 13 and spring mounted bolt 11, and the degree of contact between cooling unit 100 and roller exterior pipe 5 can be adjusted by the pressing mechanism. That is, as shown in FIG. 5, roller cooling body 4 is inserted into the inside of roller exterior pipe 5 in a state where roller cooling body 4 is separated from the inner wall of roller exterior pipe 5, and, thereafter, as shown in FIG. 4, roller cooling body 4 is brought into contact with the inner wall of roller exterior pipe 5.

Spring mounted bolt 11 is disposed on both ends of unit movable plate 13. The plurality of cooling units 100 are mounted on each pair of unit movable plates 13. Accordingly, by adjusting spring mounted bolt 11 disposed on both ends of unit movable plate 13, positions of all of the plurality of cooling units 100 mounted on the pair of unit movable plates 13 can be simultaneously adjusted.

As shown in FIG. 4, cooling units 100 which form a pair are disposed at positions symmetrical with respect to a center axis of roller exterior pipe 5. That is, cooling units 100 are disposed at right and left positions respectively with the respect to center axis of roller exterior pipe 5 or at upper and lower positions respectively with respect to the center axis of roller exterior pipe 5. Due to such a constitution, the balance of the center of gravity of roller body 1 is not deviated with respect to the center axis of roller exterior pipe 5 and hence, a vibration generated when roller body 1 rotates can be suppressed.

Roller body 1 includes: roller exterior pipe 5 which forms the exterior; thermoelectric conversion module 6; casing 300 which contains thermoelectric conversion module 6; roller exterior pipe 5 which contains casing 300; and support body 301 which brings casing 300 into contact with the inner wall of roller exterior pipe 5. Support body 301 includes: unit movable plate 13 which holds casing 300; spring mounted bolt 11 which is connected to unit movable plate 13; and support portion 7 which supports unit movable plate 13 through spring mounted bolt 11. Spring mounted bolt 11 is connected to support portion 7 such that unit movable plate 13 is movable toward the inner wall of roller exterior pipe 5. Due to such a constitution, by moving unit movable plate 13 toward the inner wall of roller exterior pipe 5 with respect to support portion 7, casing 300 fixed to unit movable plate 13 can be easily brought into close contact with the inner wall of roller exterior pipe 5 at a desired position. Thermoelectric conversion module 6 is contained in casing 300 and hence, roller exterior pipe 5 can be efficiently cooled through the inner wall of roller exterior pipe 5. By adjusting spring mounted bolt 11 which connects support portion 7 and unit movable plate 13 to each other, casing 300 can be separated from the inner wall of roller exterior pipe 5 so that casing 300 can be easily taken out from roller exterior pipe 5. Accordingly, an operator can easily take a countermeasure against a defect of thermoelectric conversion module 6 or the like so that it is possible to provide roller body 1 having excellent maintainability.

Further, casing 300 includes: mounting plate 8 which positions thermoelectric conversion module 6 with respect to support portion 7; curved plate 10 which is disposed closer to the inner wall of roller exterior pipe 5 than thermoelectric conversion module 6 and mounting plate 8 are; and heat radiation member 9 which is disposed closer to a center axis of roller exterior pipe 5 than thermoelectric conversion module 6 and mounting plate 8 are, and radiates heat of thermoelectric conversion module 6. Thermoelectric conversion module 6 and mounting plate 8 are held by curved plate 10 and heat radiation member 9. Due to such a constitution, thermoelectric conversion module 6, heat radiation member 9, and curved plate 10 are formed integrally and hence, thermoelectric conversion module 6 can efficiently cool roller exterior pipe 5 through curved plate 10, and warm heat radiation member 9. As a result, a cooling efficiency of cooling roller 200 can be increased.

A surface of curved plate 10 which faces the inner wall of roller exterior pipe 5 extends along the inner wall of roller exterior pipe 5. Due to such a constitution, a close contact area between the inner wall of roller exterior pipe 5 and curved plate 10 formed integrally with thermoelectric conversion module 6 can be increased and hence, a cooling efficiency of roller exterior pipe 5 can be increased.

The whole unit movable plate 13 and the whole support portion 7 are positioned in a hollow region of roller exterior pipe 5. Due to such a constitution, roller body 1 itself can be miniaturized.

Here, roller exterior pipe 5 is one example of "exterior pipe", unit movable plate 13 is one example of "holding portion", and spring mounted bolt 11 is one example of "connecting portion". Further, mounting plate 8 is one example of "first member", and curved plate 10 is one example of "second member".

Figure 6:
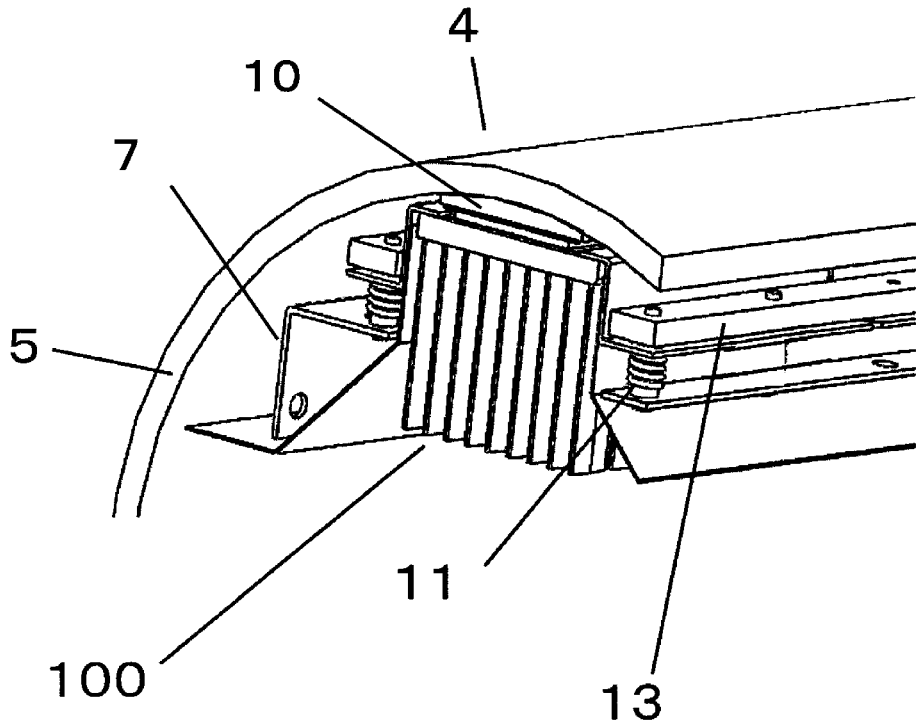
FIG. 6 is a view showing in detail a pressing mechanism of the roller cooling body according to the first exemplary embodiment.

FIG. 6 shows in detail the pressing mechanism of roller cooling body 4 according to the first exemplary embodiment. Spring mounted bolt 11 is disposed on both ends of unit movable plate 13, and the plurality of cooling units 100 are mounted on the pair of unit movable plates 13. In this exemplary embodiment, eight unit movable plates 13 form four pair of unit movable plates 13. Accordingly, by using sixteen spring mounted bolts 11 in total, positions of all of the plurality of cooling units 100 inserted in one roller exterior pipe 5 can be adjusted.

In this manner, in this exemplary embodiment, roller cooling body 4 can be easily brought into close contact with or can be separated from roller exterior pipe 5 using sixteen spring mounted bolts 11 in total.

Figure 7:
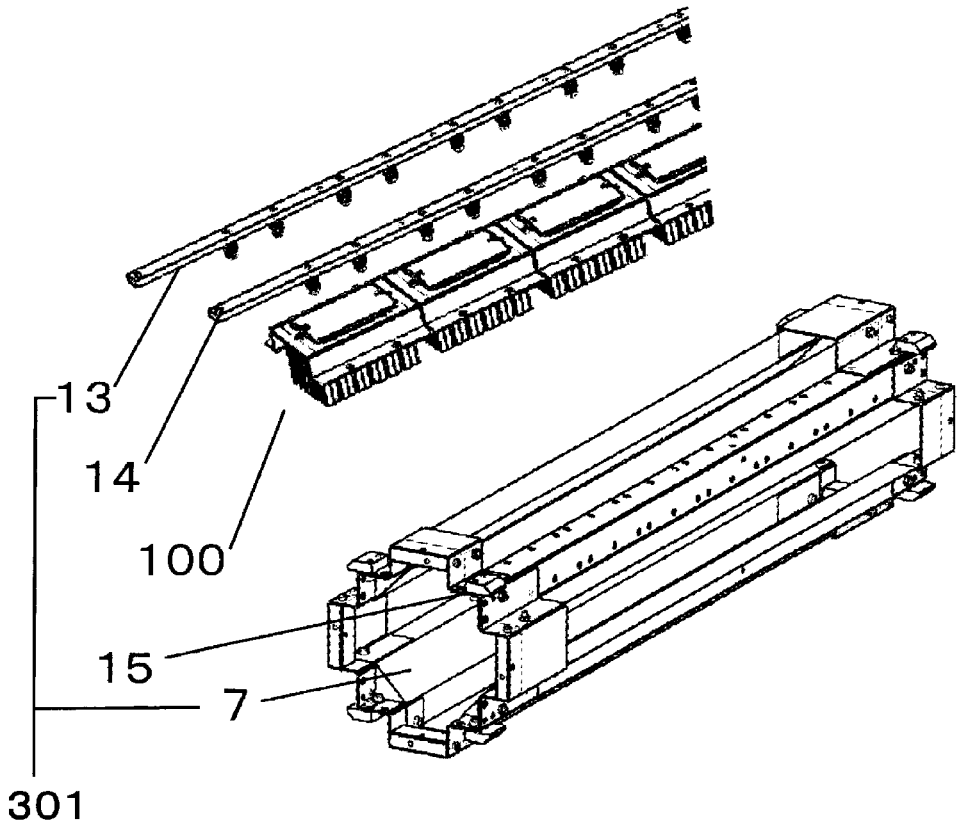
FIG. 7 is an exploded view of a roller cooling body according to the first exemplary embodiment.

FIG. 7 is an exploded view showing roller cooling body 4 according to the first exemplary embodiment. Roller cooling body 4 is constituted of support portion 7, the plurality of cooling units 100, and unit movable plate 13 to which the plurality of cooling units 100 are fixed. Support body 301 is constituted of support portion 7 and unit movable plate 13.

The plurality of cooling units 100 are mounted on the pair of unit movable plates 13. The plurality of cooling units 100 are arranged in a row such that both ends of each of cooling units 100 are fixed to the pair of unit movable plates 13 by bolts. By using spring mounted bolts as bolts for fixing cooling unit 100, cooling units 100 are freely movable with respect to unit movable plate 13 within an expansion distance of spring. Due to such a constitution, respective cooling units 100 can be moved independently. Accordingly, even when cooling units 100 have irregularity in size or unit movable plate 13 is bent, individual cooling units 100 can be brought into close contact with the inner wall of roller exterior pipe 5.

First mounting holes 14 are formed in a surface of unit movable plate 13 which faces support portion 7. Second mounting holes 15 are formed in support portion 7 at positions which face first mounting holes 14. First mounting holes 14 and second mounting holes 15 are connected to each other using spring mounted bolts 11 such that cooling units 100 are sandwiched between unit movable plate 13 and support portion 7. Due to such a constitution, the relative position between unit movable plate 13 having first mounting holes 14 and support portion 7 having second mounting holes 15 can be changed using spring mounted bolts 11 and hence, the degree of close contact between the inner wall of roller exterior pipe 5 and cooling unit 100 can be increased.

Figure 8:
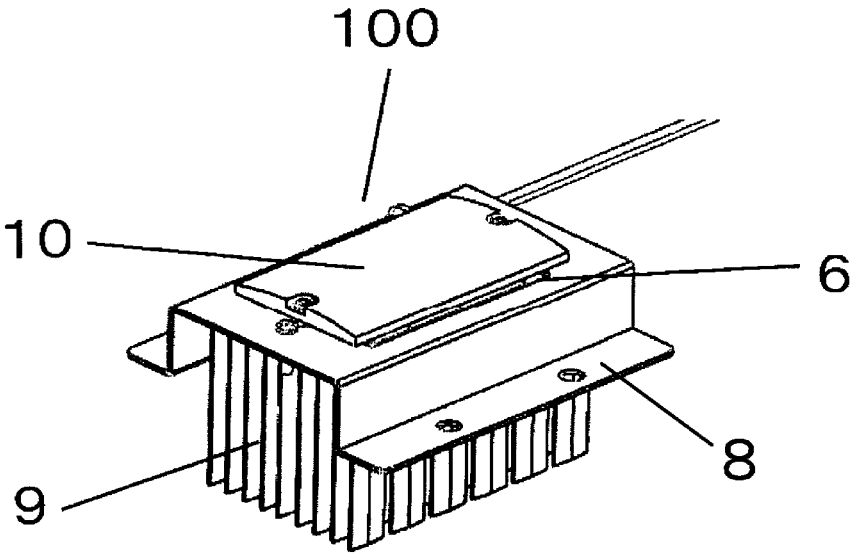
FIG. 8 is a view of a cooling unit according to the first exemplary embodiment.

FIG. 8 shows cooling unit 100 according to first exemplary embodiment. Cooling unit 100 has a function to cool roller body 1. Cooling unit 100 comprises heat radiation member 9, thermoelectric conversion module 6, mounting plate 8, and curved plate 10. These parts are firmly fixed to each other. Cooling unit 100 takes away heat from roller exterior pipe 5 through curved plate 10 by using cooling phenomenon of a Peltier effect which is generated in thermoelectric conversion module 6. On the other hand, heat generated by thermoelectric conversion module 6 is transferred to heat radiation member 9.

Figure 9:
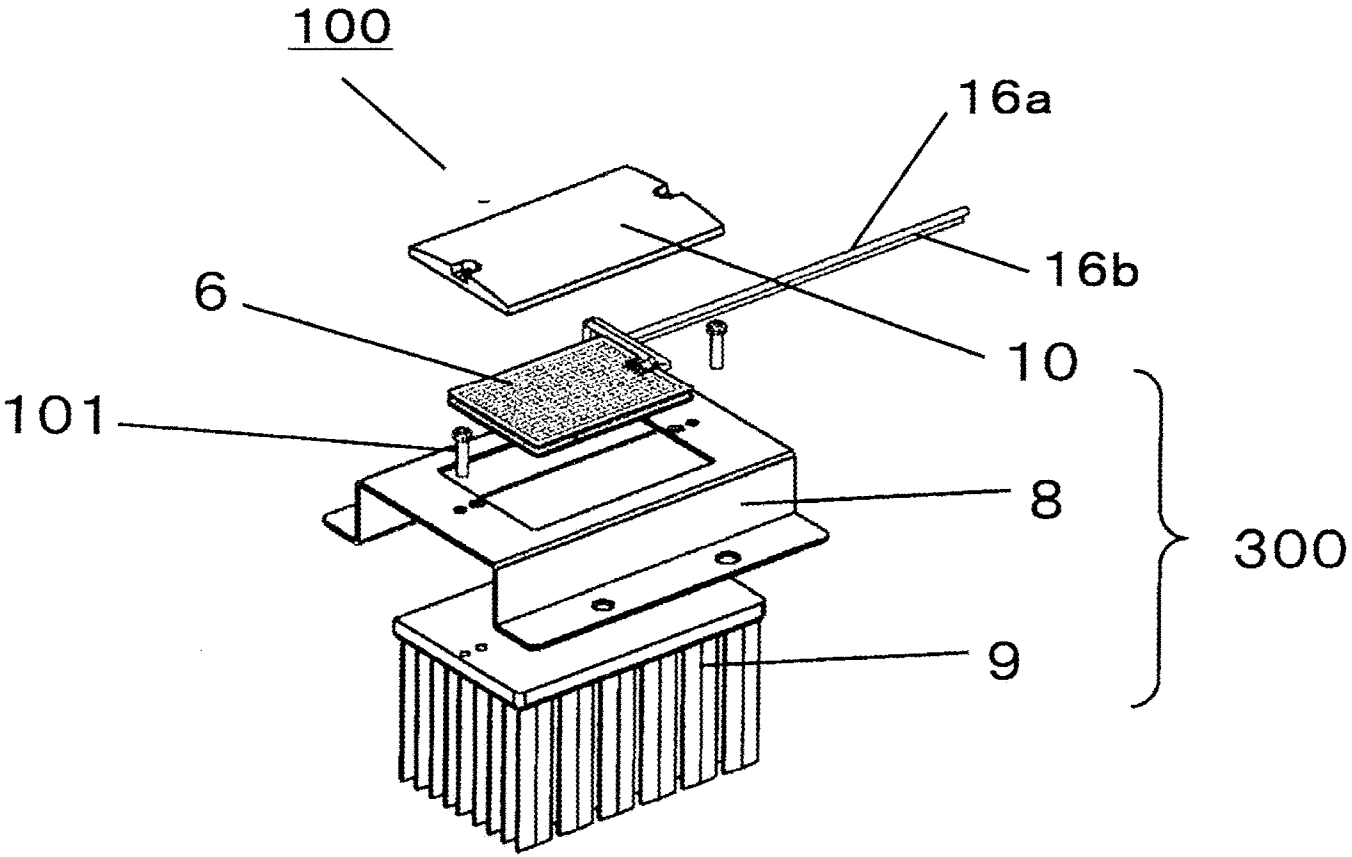
FIG. 9 is an exploded view of a cooling unit according to the first exemplary embodiment.

FIG. 9 is an exploded view of cooling unit 100 according to first exemplary embodiment. Thermoelectric conversion module 6 is disposed such that side surfaces of thermoelectric conversion module 6 are surrounded by mounting plate 8. Curved plate 10, thermoelectric conversion module 6 and heat radiation member 9 are stacked in this order, and are fixed to each other in a state where curved plate 10, thermoelectric conversion module 6 and heat radiation member 9 are brought into close contact with each other.

Thermoelectric conversion module 6 is formed to have a rectangular flat plate shape by arranging a plurality of thermoelectric conversion elements in plural rows in the longitudinal direction as well as in the lateral direction. The thermoelectric conversion element is constituted of a P-type semiconductor and an N-type semiconductor. These semiconductors have the same rectangular parallelepiped shape. The respective thermoelectric conversion elements are arranged in rows and in a concentrated manner and hence, a cooling efficiency of thermoelectric conversion module 6 can be increased. Thermoelectric conversion module 6 may be formed of a plurality of thermoelectric conversion elements, or may be formed of a single thermoelectric conversion element.

Heat radiation member 9 has the fin structure. A plurality of plate-shaped projections are formed in heat radiation member 9, and these plate-shaped projections are disposed in a spaced-apart manner from each other in four directions. Due to such a constitution, a surface area of heat radiation member 9 is increased so that a large amount of heat can be radiated.

Curved plate 10, heat radiation member 9 and mounting plate 8 are fixed to each other by fixing bolts 101 such that mounting plate 8 is sandwiched between curved plate 10 and heat radiation member 9. With this structure, heat radiation member 9, curved plate 10 and mounting plate 8 constitute casing 300 which contains thermoelectric conversion module 6.

Cooling unit 100 includes lead line 16*a* and lead line 16*b* through which electric power is supplied to thermoelectric conversion module 6. Lead line 16*a* and lead line 16*b* are connected to thermoelectric conversion module 6 disposed adjacent to each other. And lead line 16*a* and lead line 16*b* are connected to a control device (not shown in the drawing) disposed outside cooling unit 100.

By bringing curved plate 10 and heat radiation member 9 into close contact with thermoelectric conversion module 6, a cooling efficiency of cooling unit 100 can be increased. Thermal conductivity between curved plate 10 and thermoelectric conversion module 6 or thermal conductivity between heat radiation member 9 and thermoelectric conversion module 6 may be increased by applying a thermally conductive grease or the like between them.

Figure 10:
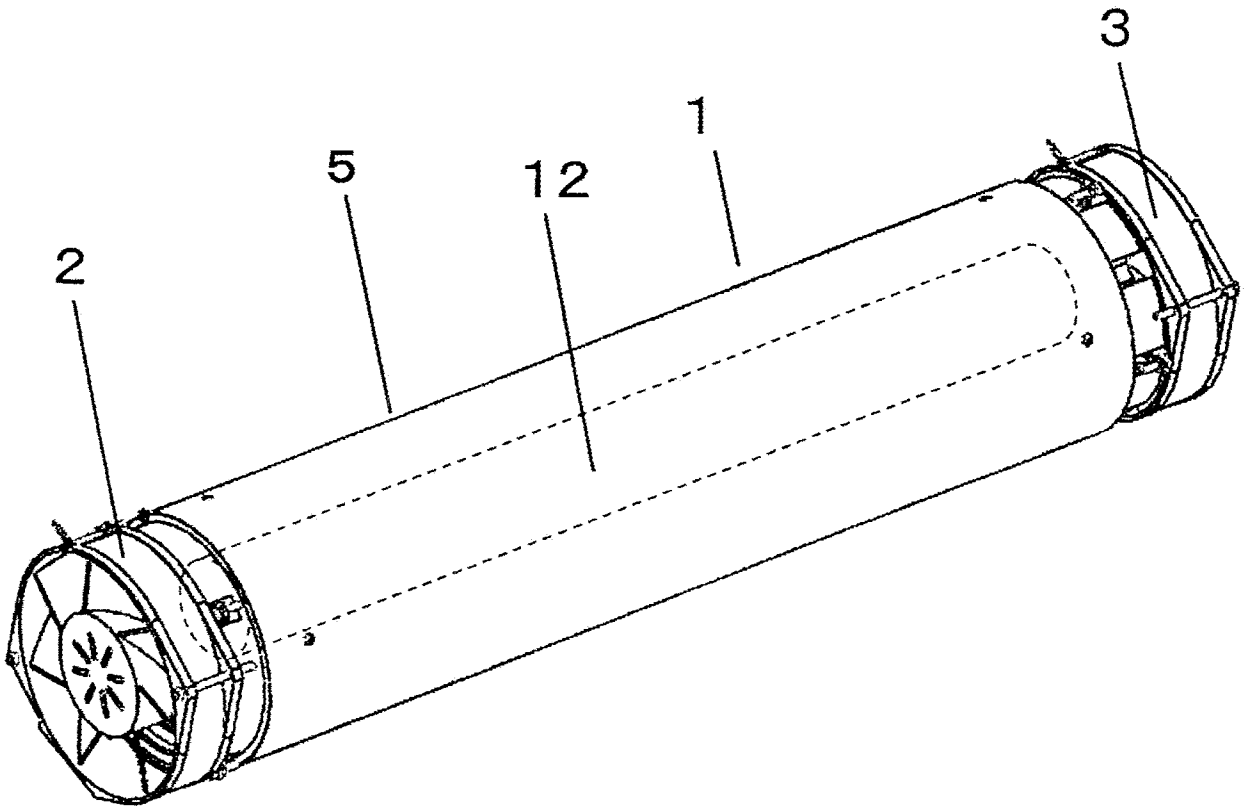
FIG. 10 is a perspective view showing an air flow direction adjustment pole disposed inside the cooling roller according to the first exemplary embodiment.

FIG. 10 is a perspective view showing air flow direction adjustment pole 12 disposed inside cooling roller 200 according to the first exemplary embodiment. By arranging air flow direction adjusting pole 12 inside roller body 1, a cooling efficiency of roller body 1 can be increased.

Air taken into the inside of roller body 1 by outside air suction fan 2 flows along a side surface of air flow direction adjusting pole 12 so that the flow of air inside roller body 1 is adjusted. By directing the flow of air toward heat radiation member 9, a heat radiation effect of heat radiation member 9 is increased so that a cooling efficiency of roller body 1 can be increased. Air heated by heat radiation member 9 is also guided along the side surface of air flow direction adjusting pole 12, and is discharged to the outside of roller body 1 by inside air discharge fan 3. As described above, with the provision of air flow direction adjusting pole 12, a heat radiation effect of heat radiation member 9 is increased so that a cooling efficiency of a roller is increased.

Outside air suction fan 2 or inside air discharge fan 3 is disposed such that the center of rotation of outside air suction fan 2 or the center of rotation of inside air discharge fan 3 is positioned on a center axis of air flow direction adjusting pole 12. Due to such arrangement, it is possible to supply air on an outer peripheral side of outside air suction fan 2 or inside air discharge fan 3 to the inside of roller exterior pipe 5 without being interrupted by air flow direction adjusting pole 12. A speed of air on an outer peripheral side of outside air suction fan 2 or inside air discharge fan 3 is faster than that of air on the center of rotation of outside air suction fan 2 or on the center of rotation of inside air discharge fan 3. Accordingly, a heat radiation effect of heat radiation member 9 can be further increased.

By setting an outer diameter of outside air suction fan 2 or an outer diameter of inside air discharge fan 3 substantially equal to a diameter of an opening of roller exterior pipe 5, outside air suction fan 2 or inside air discharge fan 3 can be attached on roller exterior pipe 5 and, at the same time, air can be flown into the inside of roller body 1 through the whole opening of roller exterior pipe 5. Accordingly, an amount of air flown into the inside of roller body 1 can be increased so that heat radiation member 9 can be efficiently cooled. Roller body 1 may have both or either one of outside air suction fan 2 and inside air discharge fan 3. When roller body 1 has both outside air suction fan 2 and inside air discharge fan 3, an amount of air flown into the inside of roller body 1 through the opening of roller exterior pipe 5 can be increased so that heat radiation member 9 can be efficiently cooled.

Air flow direction adjusting pole 12 is supported by a housing of outside air suction fan 2 and a housing of inside air discharge fan 3. Due to such a constitution, air flow direction adjusting pole 12 can be stably fixed to roller exterior pipe 5 by means of the housing which forms a part of outside air suction fan 2 and the housing which forms a part of inside air discharge fan 3.

Second Exemplary Embodiment

Figure 11:
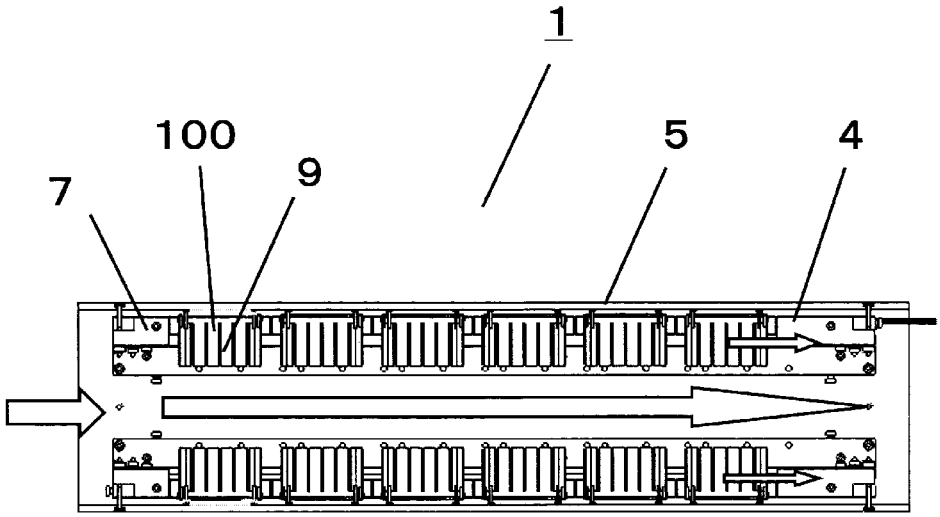
FIG. 11 is a view showing the internal structure of a roller body according to a second exemplary embodiment.

FIG. 11 shows the internal structure of roller body 1 according to a second exemplary embodiment. In this exemplary embodiment, roller body 1 has no air flow direction adjusting pole in the inside thereof. Arrows in the drawing show the flow of air.

Roller body 1 comprises roller cooling body 4 and roller exterior pipe 5. Roller cooling body 4 comprises cooling unit 100 and support portion 7, and has an approximately cylindrical shape so as to extend along an inner wall of roller exterior pipe 5. Heat radiation member 9 is arranged in cooling unit 100, and heat radiation member 9 radiates heat of cooling unit 100.

An opening of roller body 1 which is positioned on a left side in FIG. 11 constitutes a suction port, and an opening of roller body 1 which is positioned on a right side in FIG. 11 constitutes a discharge port. Air sucked through the suction port is moved in the inside of roller exterior pipe 5 and, thereafter, is discharged from a discharge port.

Air inside roller body 1 which is heated by heat radiation member 9 is expelled by the air sucked through the suction port so that a temperature of air inside roller body 1 is hardly elevated. Accordingly, a cooling efficiency of cooling roller 200 can be increased.

In the constitution of this exemplary embodiment, air flow direction adjusting pole is not provided and hence, most of air sucked through the suction port passes through a center region of roller exterior pipe 5 including an area on a center axis of roller exterior pipe 5. Accordingly, most of air sucked through the suction port cannot pass a peripheral region where heat radiation member 9 is positioned and hence, a heat radiation effect of heat radiation member 9 is not so largely increased.

On the other hand, the flow of air is not interrupted by an air flow direction adjusting pole and hence, a load applied to outside air suction fan 2 or a load applied to inside air discharge fan 3 is decreased whereby the occurrence of a defect or the like can be suppressed. And an assembling step can be simplified because it is unnecessary to dispose the air flow direction adjusting pole along a center axis of roller body 1.

Third Exemplary Embodiment

Figure 12A:
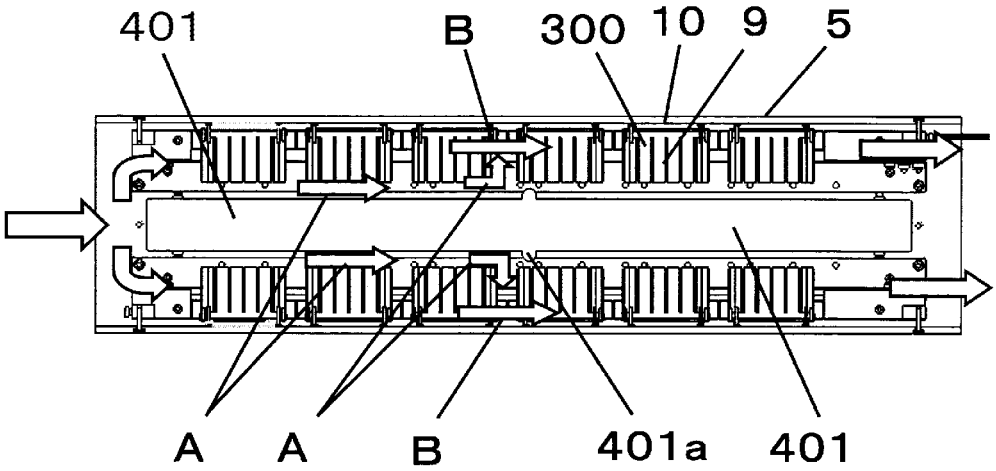
FIG. 12A is a view showing the internal structure of a roller body according to a third exemplary embodiment.
Figure 12B:
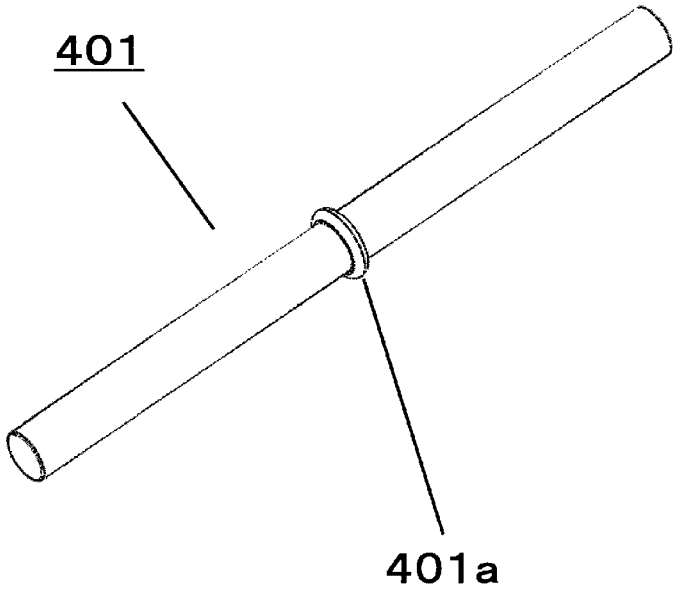
FIG. 12B is an appearance view of an air flow direction adjustment pole according to the third exemplary embodiment.

FIG. 12A is a view showing the internal structure of roller body 1 according to a third exemplary embodiment, and FIG. 12B is an appearance view of air flow direction adjusting pole 401 according to the third exemplary embodiment. The constitution shown in FIG. 12A differs from the constitution shown in FIG. 11 with respect to a point that the constitution shown in FIG. 12A includes air flow direction adjusting pole 401. Arrows in FIG. 12A show the flow of air.

Roller exterior pipe 5 forms the exterior of roller body 1, and has two openings. An opening positioned on a left side in FIG. 12A constitutes a suction port, and an opening positioned on a right side in FIG. 12A constitutes a discharge port. A plurality of casings 300, each of which contains thermoelectric conversion module 6 therein, are disposed inside roller exterior pipe 5. Curved plates 10 of casings 300 are brought into contact with an inner wall of roller exterior pipe 5, and heat radiation members 9 of casings 300 are disposed at positions close to a center axis of roller exterior pipe 5.

Air flow direction adjusting pole 401 is disposed in casing 300 at a position closer to the center axis than heat radiation member 9 is. Air flow direction adjusting pole 401 is positioned inside roller exterior pipe 5 so that air flow direction adjusting pole 401 adjust the flow of air by narrowing an air flow passage in the inside of roller exterior pipe 5.

In this exemplary embodiment, air flow direction adjusting pole 401 is positioned on the center axis of roller exterior pipe 5. Accordingly, as shown in FIG. 12A, the flow of air which is flown into the inside of exterior pipe 5 through the opening of roller exterior pipe 5 is flown away from the center axis of roller exterior pipe 5, and is directed toward casing 300 which contains thermoelectric conversion module 6. Due to such a constitution, heat radiation members 9 of casings 300 can be efficiently cooled and hence, a cooling efficiency of cooling roller 200 can be increased.

In this exemplary embodiment, fins of heat radiation member 9 extend toward air flow direction adjusting pole 401. In this manner, by arranging heat radiation members 9 of casings 300 such that heat radiation members 9 are disposed between air flow direction adjusting pole 401 and bodies of casings 300, the flow of air flown into roller exterior pipe 5 through the opening of roller exterior pipe 5 can be easily flown into the inside of heat radiation members 9. And thermoelectric conversion elements contained in casing 300 can be efficiently cooled through heat radiation member 9.

Further, as shown in FIG. 12B, air flow direction adjusting pole 401 has projection 401*a* which projects toward casing 300. Projection 401*a* is formed by partially increasing a diameter of air flow direction adjusting pole 401. Projection 401*a* of air flow direction adjusting pole 401 directs the flow of air which flows along air flow direction adjusting pole 401 (indicated by arrows A in FIG. 12A) toward casing 300. Accordingly, the flow of air which flows in an air flow direction adjusting pole 401 side (indicated by the arrows A in FIG. 12A) and the flow of air which flows in a casing 300 side (indicated by arrows B in FIG. 12A) are mixed with each other so that the temperature distribution of air which flows in the inside of roller exterior pipe 5 is made uniform and hence, heat radiation members 9 of casings 300 can be efficiently cooled.

Air flow direction adjusting pole 401 has an approximately circular columnar shape, and has no opening at end portions thereof directed toward the openings of roller exterior pipe 5. Accordingly, even when the whole air flow direction adjusting pole 401 is positioned inside roller exterior pipe 5, there is no possibility that air is flown into the inside of air flow direction adjusting pole 401. Assume a case where air flow direction adjusting pole 401 has an approximately cylindrical shape, and has openings at end portions thereof directed toward openings of roller exterior pipe 5. In such a case, the end portions of air flow direction adjusting pole 401 are positioned outside roller exterior pipe 5. With this arrangement, it is possible to prevent air from being flown into the inside of air flow direction adjusting pole 401.

Fourth Exemplary Embodiment

Figure 13A:
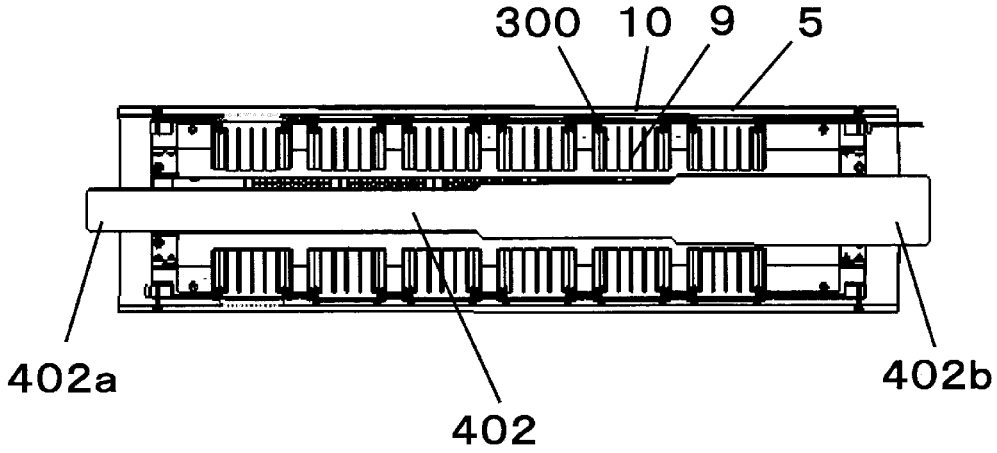
FIG. 13A is a view showing the internal structure of a roller body according to a fourth exemplary embodiment.
Figure 13B:
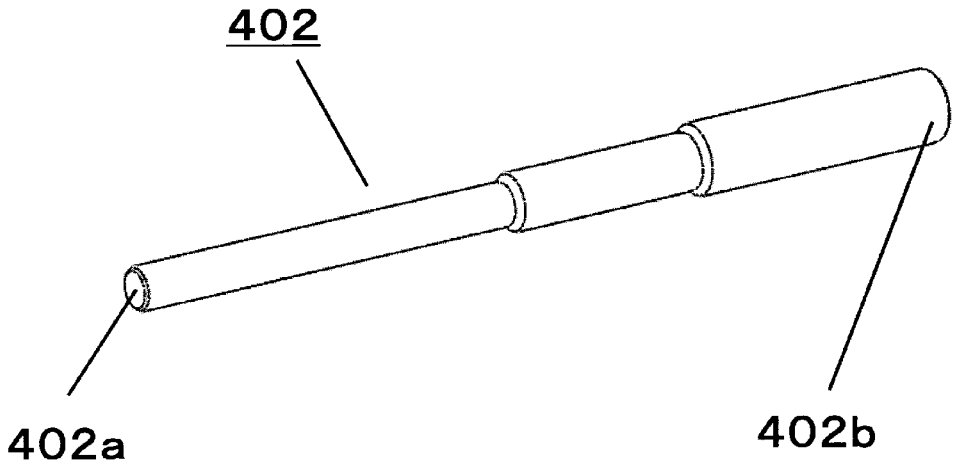
FIG. 13B is an appearance view of an air flow direction adjustment pole according to the fourth exemplary embodiment.

FIG. 13A is a view showing the internal structure of roller body 1 according to a fourth exemplary embodiment, and FIG. 13B is an appearance view of air flow direction adjusting pole 402 according to the fourth exemplary embodiment. A different point between the constitution shown in FIG. 12A and the constitution shown in FIG. 13A is an appearance shape of an air flow direction adjusting pole.

Roller exterior pipe 5 forms the exterior of roller body 1, and has two openings. An opening positioned on a left side in FIG. 13A constitutes a suction port, and an opening positioned on a right side in FIG. 13A constitutes a discharge port.

The constitutions of roller exterior pipe 5, heat radiation member 9, curved plate 10 and casing 300 are the same as the corresponding constitutions shown in FIG. 12A.

As shown in FIG. 13B, air flow direction adjusting pole 402 has an approximately circular columnar shape, and includes first end portion 402*a* and second end portion 402*b*. A diameter of first end portion 402*a* is smaller than a diameter of second end portion 402*b*, first end portion 402*a* is positioned on a suction port side of roller exterior pipe 5, and second end portion 402*b* is positioned on a discharge port side of roller exterior pipe 5. That is, an air flow passage is wide on a suction port side of roller exterior pipe 5, and the air flow passage is narrow on a discharge port side of roller exterior pipe 5. Due to such a constitution, a large amount of air can be taken into the inside of roller exterior pipe 5 on the suction port side of roller exterior pipe 5. Further, as the flow of air advances to the discharge port side of roller exterior pipe 5, the air flow passage becomes narrower so that a flow speed of air in the vicinity of casings 300 is increased and hence, heat radiation members 9 of casings 300 can be efficiently cooled.

Air flow direction adjusting pole 402 is formed such that a diameter of air flow direction adjusting pole 402 is increased toward second end portion 402*b* from first end portion 402*a* in a stepwise manner. Due to such a constitution, a flow speed is increased in a stepwise manner as the flow of air advances to the discharge port side of roller exterior pipe 5. Air taken in roller exterior pipe 5 is heated as the air advances to the discharge port side of roller exterior pipe 5 from the suction port side of roller exterior pipe 5, and a temperature of the air is elevated as the air advances to the discharge port side of roller exterior pipe 5 from the suction port side of roller exterior pipe 5. Accordingly, by increasing an air flow speed on the discharge port side of roller exterior pipe 5 where a temperature of air is high compared to a temperature of air on the suction port side of roller exterior pipe 5, it is possible to prevent an amount of heat radiated from the heat radiation member 9 from becoming unbalanced between the suction port side of roller exterior pipe 5 and the discharge port side of roller exterior pipe 5. As a result, it is possible to suppress the occurrence of a case where a temperature of a surface of roller body 1 becomes non-uniform.

Also in this exemplary embodiment, in the same manner as the third exemplary embodiment, air flow direction adjusting pole 402 is formed into an approximately circular columnar shape. However, air flow direction adjusting pole 402 may be formed into a cylindrical shape. When air flow direction adjusting pole 402 has an opening at first end portion 402*a* and an opening at second end portion 402*b*, it is necessary to make first end portion 402*a* and second end portion 402*b* positioned outside roller exterior pipe 5. Further, when air flow direction adjusting pole 402 does not have opening either at first end portion 402*a* or at second end portion 402*b*, first end portion 402*a* and second end portion 402*b* may be positioned outside roller exterior pipe 5 or may be positioned inside roller exterior pipe 5.

Fifth Exemplary Embodiment

Figure 14A:
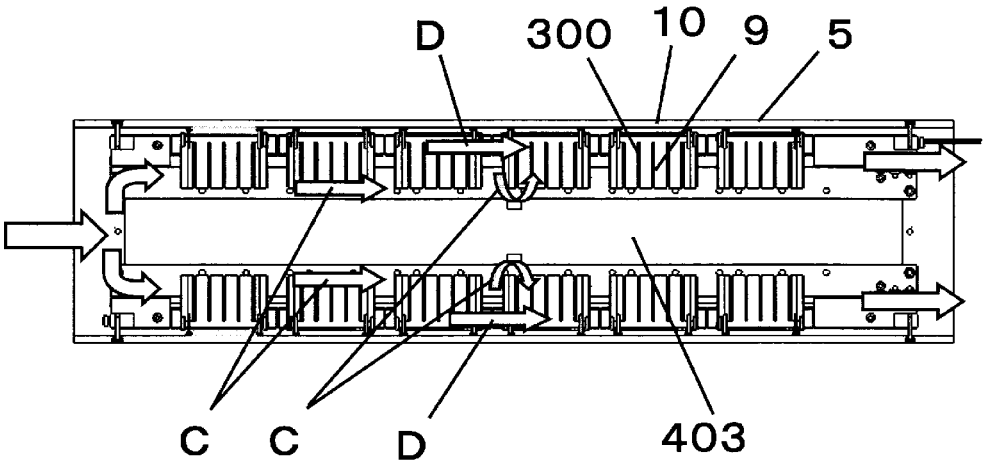
FIG. 14A is a view showing the internal structure of a roller body according to a fifth exemplary embodiment.
Figure 14B:
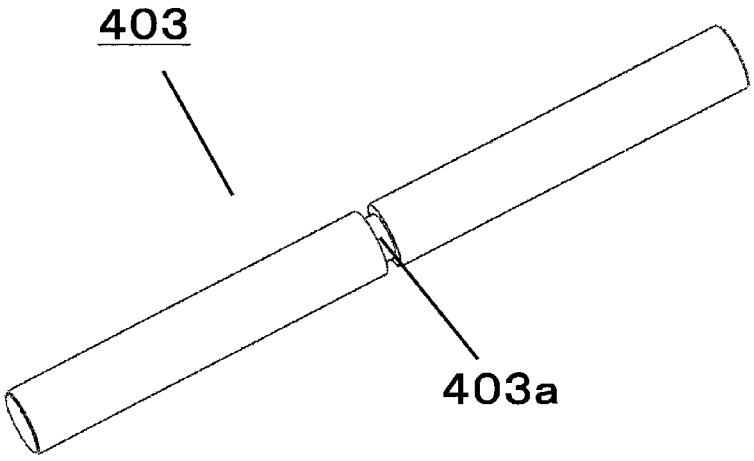
FIG. 14B is an appearance view of an air flow direction adjustment pole according to the fifth exemplary embodiment.

FIG. 14A is a view showing the internal structure of roller body 1 according to a fifth exemplary embodiment, and FIG. 14B is an appearance view of air flow direction adjusting pole 403 according to the fifth exemplary embodiment. A different point between the constitution shown in FIG. 12A and the constitution shown in FIG. 14A is an appearance shape of an air flow direction adjusting pole. Arrows in FIG. 14A show the flow of air.

Roller exterior pipe 5 forms the exterior of roller body 1, and has two openings. An opening positioned on a left side in FIG. 14A constitutes a suction port, and an opening positioned on a right side in FIG. 14A constitutes a discharge port.

The constitutions of roller exterior pipe 5, heat radiation member 9, curved plate 10 and casing 300 are the same as the corresponding constitutions shown in FIG. 12A.

As shown in FIG. 14B, air flow direction adjusting pole 403 includes groove 403*a*. Groove 403*a* is formed by partially decreasing a diameter of air flow direction adjusting pole 403. The direction of the flow of air which flows along air flow direction adjusting pole 403 (indicated by arrows C in FIG. 14A) is changed by groove 403*a* such that the flow of air is also directed toward casing 300. Accordingly, the flow of air which flows along air flow direction adjusting pole 403 (indicated by the arrows C in FIG. 14A) and the flow of air which flows in casing 300 (indicated by arrows D in FIG. 14A) are mixed to each other so that the temperature distribution of air which flows inside roller exterior pipe 5 is made uniform whereby heat radiation member 9 of casing 300 can be efficiently cooled.

Sixth Exemplary Embodiment

Figure 15:
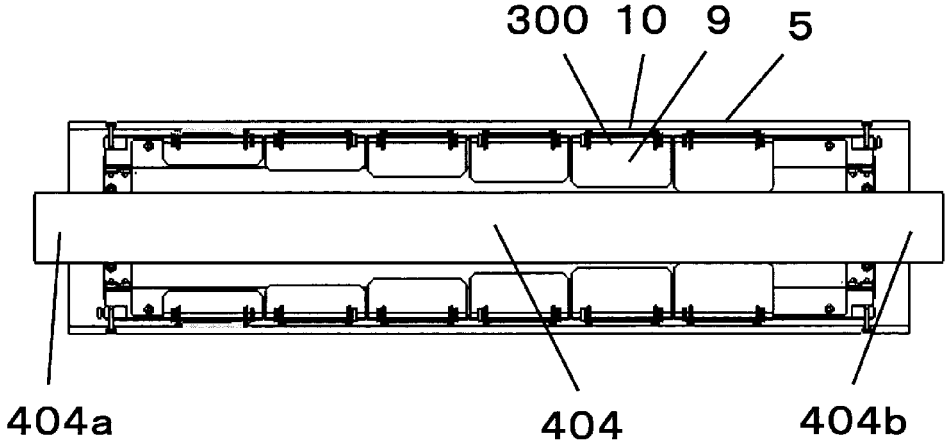
FIG. 15 is a view showing the internal structure of a roller body according to a sixth exemplary embodiment.

FIG. 15 is a view showing the internal structure of roller body 1 according to a sixth exemplary embodiment, and roller body 1 includes an air flow direction adjusting pole therein. A different point between the constitution shown in FIG. 12A and the constitution shown in FIG. 15 is an appearance shape of the air flow direction adjusting pole and a position of a heat radiation member with respect to the air flow direction adjusting pole.

Roller exterior pipe 5 forms the exterior of roller body 1, and has two openings. An opening positioned on a left side in FIG. 15 constitutes a suction port, and an opening positioned on a right side in FIG. 15 constitutes a discharge port.

In this exemplary embodiment, different from the constitution shown in FIG. 12A, a size of heat radiation member 9 is gradually increased as heat radiation member 9 advances toward a discharge port side of roller exterior pipe 5 from a suction port side of roller exterior pipe 5. Further, different from air flow direction adjusting pole 401 shown in FIG. 12B, air flow direction adjusting pole 404 has an approximately circular columnar shape which has no projection portion. Other constitutions are substantially the same as the corresponding constitutions shown in FIG. 12A.

As shown in FIG. 15, the size of heat radiation member 9 of casing 300 on the discharge port side of roller exterior pipe 5 is larger than the size of heat radiation member 9 of casing 300 on the suction port side of roller exterior pipe 5 in the direction perpendicular to a center axis. That is to say, as a position of heat radiation member 9 advances toward the discharge port side of roller exterior pipe 5 from the suction port side of roller exterior pipe 5, a distance between heat radiation member 9 and air flow direction adjusting pole 404 is decreased. Due to such a constitution, an air flow passage is large on the suction port side of roller exterior pipe 5, and the air flow passage is small on the discharge port side of roller exterior pipe 5. Accordingly, a large amount of air is taken into the inside of roller exterior pipe 5 on the suction port side of roller exterior pipe 5 and, at the same time, an air flow speed is increased on the discharge port side of roller exterior pipe 5. As a result, heat radiation member 9 of casing 300 can be efficiently cooled.

In this exemplary embodiment, a size of heat radiation member 9 is increased in the direction perpendicular to the center axis as radiation member 9 advances toward the discharge port side of roller exterior pipe 5 from the suction port side of roller exterior pipe 5. Air taken in roller exterior pipe 5 is heated as the air advances to the discharge port side of roller exterior pipe 5 from the suction port side of roller exterior pipe 5, and a temperature of the air is elevated as the air advances to the discharge port side of roller exterior pipe 5 from the suction port side of roller exterior pipe 5. Accordingly, by increasing a size of heat radiation member 9 on the discharge port side of roller exterior pipe 5 where a temperature of air is high compared to a temperature of air on the suction port side of roller exterior pipe 5, it is possible to prevent an amount of heat radiated from the heat radiation member 9 from becoming unbalanced between the suction port side of roller exterior pipe 5 and the discharge port side of roller exterior pipe 5. As a result, it is possible to suppress the occurrence of a case where a temperature of a surface of roller body 1 becomes non-uniform.

Seventh Exemplary Embodiment

Figure 16A:
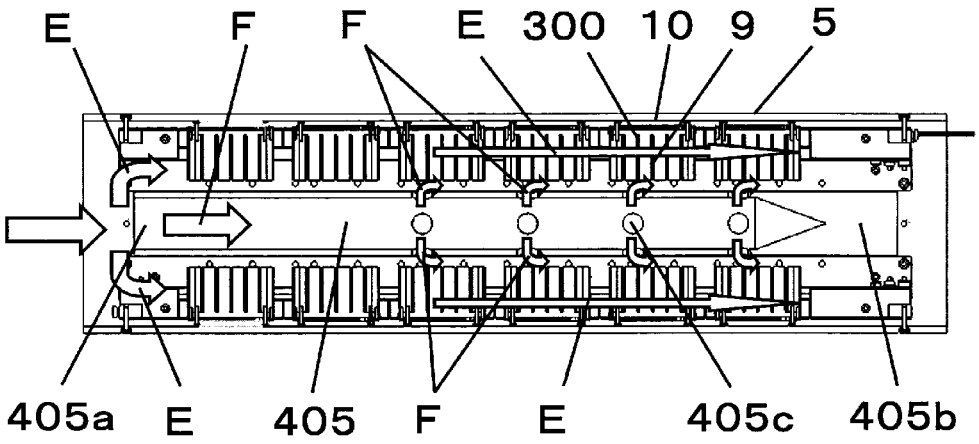
FIG. 16A is a view showing the internal structure of a roller body according to a seventh exemplary embodiment.
Figure 16B:
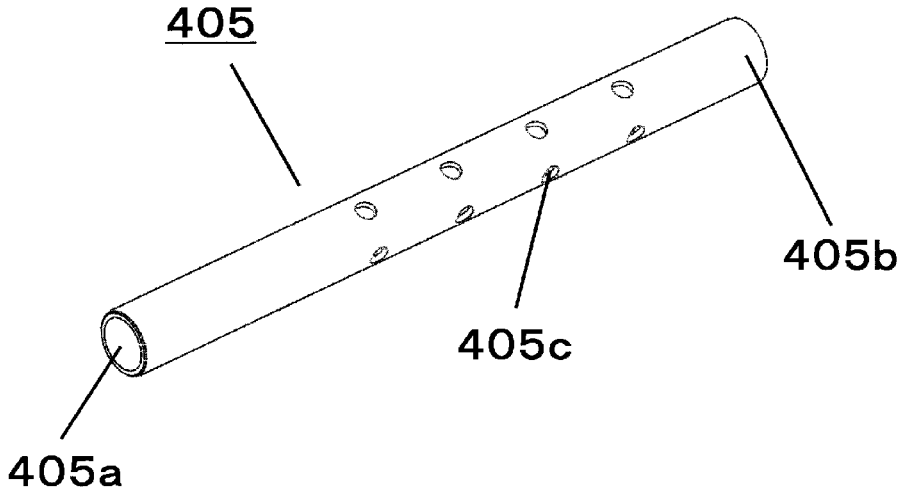
FIG. 16B is an appearance view of an air flow direction adjustment pole according to the seventh exemplary embodiment.

FIG. 16A is a view showing the internal structure of a roller according to a seventh exemplary embodiment, and FIG. 16B is an appearance view of air flow direction adjusting pole 405 according to the seventh exemplary embodiment. A different point between the constitution shown in FIG. 12A and the constitution shown in FIG. 16B is an appearance shape of the air flow direction adjusting pole. Arrows in FIG. 16A show the flow of air.

Roller exterior pipe 5 forms the exterior of the roller, and has two openings. An opening positioned on a left side in FIG. 16A constitutes a suction port, and an opening positioned on a right side in FIG. 16A constitutes a discharge port.

The constitutions of roller exterior pipe 5, heat radiation member 9, curved plate 10 and casing 300 are the same as the corresponding constitutions shown in FIG. 12A.

As shown in FIG. 16B, air flow direction adjusting pole 405 has an opening at first end portion 405*a* on a suction port side, and has a closed end or an opening smaller than the opening of first end portion 405*a* at second end portion 405*b* on a discharge port side. The opening at first end portion 405*a* is positioned inside roller exterior pipe 5. Further, air flow direction adjusting pole 405 has through holes 405*c* each of which connects an inner wall surface of air flow direction adjusting pole 405 and an outer wall surface of air flow direction adjusting pole 405 to each other, and through holes 405*c* face casing 300.

Air which is flown into roller exterior pipe 5 through the opening of roller exterior pipe 5 is divided into the flow of air which passes outside of air flow direction adjusting pole 405 (indicated by arrows E in FIG. 16A) and the flow of air which passes inside of air flow direction adjusting pole 405 (indicated by arrows F in FIG. 16A). The flow of air which passes inside of air flow direction adjusting pole 405 (indicated by the arrows F in FIG. 16A) is flown toward casing 300 from through holes 405*c*. As a result, heat radiation member 9 is cooled mainly by air which passes outside of air flow direction adjusting pole 405 (indicated by the arrows E in FIG. 16A) on the suction port side of roller exterior pipe 5, and heat radiation member 9 is cooled mainly by air which is flown to a casing 300 side from through holes 405*c* and passes inside of air flow direction adjusting pole 405 (indicated by the arrows F in FIG. 16A) on the discharge port side of roller exterior pipe 5.

Accordingly, heat radiation members 9 can be cooled by air of a low temperature over an area ranging from the suction port side to the discharge port side and hence, it is possible to prevent an amount of heat radiated from the heat radiation member 9 from becoming unbalanced between the suction port side of roller exterior pipe 5 and the discharge port side of roller exterior pipe 5. As a result, it is possible to suppress the occurrence of a case where a temperature of a surface of the roller becomes non-uniform.

Figure 17:
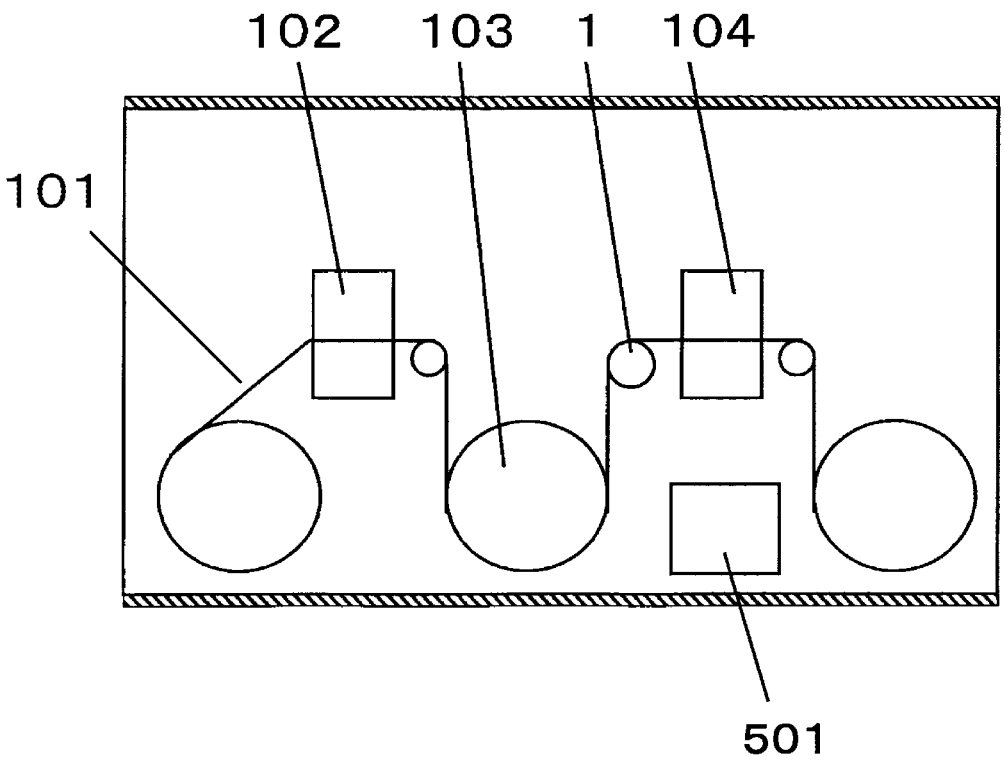
FIG. 17 is a schematic diagram showing the arrangement of the printer for industrial use according to the exemplary embodiment of this disclosure.

FIG. 17 is a schematic diagram showing the arrangement of the printer for industrial use according to the exemplary embodiment of this disclosure. When rolled sheet 101 which is to be printed is supplied to the inside of the printer, printing is performed to a front surface of rolled sheet 101 by front surface printing part 102. Next, the printed matter to which surface printing is performed by front surface printing part 102 is fed to dryer 103, and is heated inside dryer 103 where ink is dried. Thereafter, the printed matter after surface printing is fed to back surface printing part 104 while being in contact with roller body 1.

The printed matter immediately after being heated by dryer 103 is a high temperature. Accordingly, when printing is performed to a back surface of the printed matter without performing any treatment, a temperature condition at the time of applying ink to the back surface of the printed matter is not appropriate and hence, printing on back surface of the printed matter is not performed as desired. Accordingly, it is necessary to lower a temperature of the printed matter to an appropriate temperature before printing is performed to the back surface by back surface printing part 104.

Accordingly, by arranging roller body 1 according to the exemplary embodiments of the present disclosure after a heating and drying step by dryer 103, heat of the printed matter after surface printing can be efficiently absorbed by roller body 1 so that the printed matter after surface printing is cooled to an appropriate temperature within a short time.

As described above, with respect to the printer which uses cooling roller 200 of the exemplary embodiments of the present disclosure, the printer itself can be miniaturized and, at the same time, a printing time for performing both-surface printing can be shortened.

In the exemplary embodiments of the present disclosure, roller body 1 which has high cooling efficiency is used and hence, the printer can be miniaturized by decreasing the number of roller bodies 1 to be used.

In the above-mentioned exemplary embodiments, the explanation has been made with respect to the constitution where roller body 1 shown in FIG. 1 and FIG. 2 includes outside air suction fan 2 or inside air discharge fan 3. However, as shown in FIG. 17, by arranging air blower 501 which blows out air toward an opening of roller exterior pipe 5 of roller body 1 on a printer body, it is possible to make outside air suction fan 2 or inside air discharge fan 3 unnecessary. In such a case, by supplying air toward the opening of roller exterior pipe 5 of roller body 1 using a pipe or the like from air blower 501, the radiation of heat from heat radiation member 9 or the like inside roller body 1 can be enhanced. Accordingly, compared to a case where a fan is disposed on individual roller body 1, maintenance property of the printer is increased.

What is claimed is:

1. A temperature adjusting member comprising:

a thermoelectric conversion module;

a casing which contains the thermoelectric conversion module;

an exterior pipe which contains the casing; and a support body which brings the casing into contact with an inner wall of the exterior pipe, wherein the support body includes a holding portion, a connecting portion and a support portion: the holding portion holds the casing; the connecting portion is connected to the holding portion; and the support portion supports the holding portion through the connecting portion, and the connecting portion is connected to the support portion such that the holding portion is movable toward the inner wall of the exterior pipe.

2. The temperature adjusting member according to claim 1, wherein the casing comprises:

a first member which positions the thermoelectric conversion module with respect to the support body;

a second member which is disposed closer to the inner wall of the exterior pipe than the thermoelectric conversion module and the first member are; and a heat radiation member which is disposed closer to a center axis of the exterior pipe than the thermoelectric conversion module and the first member are, and radiates heat transferred from the thermoelectric conversion module, and wherein the thermoelectric conversion module and the first member are held by the second member and the heat radiation member.

3. The temperature adjusting member according to claim 1, wherein the holding portion has a first mounting hole in a surface which faces the support portion, the support portion has a second mounting hole at a position which faces the first mounting hole, and the connecting portion includes a bolt which connects the first mounting hole and the second mounting hole to each other in a state where the casing is sandwiched between the holding portion and the support portion.

4. The temperature adjusting member according to claim 2, wherein the second member has a surface which faces the inner wall of the exterior pipe and the surface extends along the inner wall of the exterior pipe.

5. The temperature adjusting member according to claim 1, wherein the holding portion and the support portion of the support body are entirely positioned in a hollow region of the exterior pipe.

6. The temperature adjusting member according to claim 1, wherein the temperature adjusting member is a roller or a cylinder.

7. A printer comprising:

a temperature adjusting member which includes:

a thermoelectric conversion module; a casing which contains the thermoelectric conversion module;

an exterior pipe which contains the casing; and a support body which brings the casing into contact with an inner wall of the exterior pipe, the support body including a holding portion, a connecting portion and a support portion: the holding portion holds the casing; the connecting portion is connected to the holding portion; and the support portion supports the holding portion through the connecting portion, and the connecting portion being connected to the support portion such that the holding portion is movable toward the inner wall of the exterior pipe;

a front surface printing part which prints a front surface of a material to be printed;

a dryer which dries a printed matter printed by the front surface printing part; and a back surface printing part which prints a back surface of the printed matter, wherein the printed matter dried by the dryer is printed by the back surface printing part after a temperature of the printed matter is adjusted by the temperature adjusting member.

8. The printer according to claim 7, wherein the casing comprises:

a first member which positions the thermoelectric conversion module with respect to the support body;

a second member which is disposed closer to the inner wall of the exterior pipe than the thermoelectric conversion module and the first member are; and a heat radiation member which is disposed closer to a center axis of the exterior pipe than the thermoelectric conversion module and the first member are, and radiates heat transferred from the thermoelectric conversion module, and wherein the thermoelectric conversion module and the first member are held by the second member and the heat radiation member.

9. The printer according to claim 7, wherein the holding portion has a first mounting hole in a surface which faces the support portion, the support portion has a second mounting hole at a position which faces the first mounting hole, and the connecting portion includes a bolt which connects the first mounting hole and the second mounting hole to each other in a state where the casing is sandwiched between the holding portion and the support portion.

10. The printer according to claim 8, wherein the second member has a surface which faces the inner wall of the exterior pipe and the surface extends along the inner wall of the exterior pipe.

11. The printer according to claim 7, wherein the holding portion and the support portion of the support body are entirely positioned in a hollow region of the exterior pipe.

12. The printer according to claim 7, wherein the temperature adjusting member is a roller or a cylinder.

* * * * *